US008544992B2

(12) United States Patent
Otis et al.

(10) Patent No.: US 8,544,992 B2
(45) Date of Patent: Oct. 1, 2013

(54) FLUID CARTRIDGE FOR A PRINTING DEVICE

(75) Inventors: David R. Otis, Corvallis, OR (US); Dan Brown, Monmouth, OR (US); Scott Martin, Vancouver, WA (US); John A. Myers, Corvallis, OR (US); Curt Gonzales, Corvallis, OR (US); Ian Patrick Anderson, Portland, OR (US); Marc A. Baldwin, Corvallis, OR (US); Thomas C. Iaia, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 159 days.

(21) Appl. No.: 13/203,413

(22) PCT Filed: Feb. 27, 2009

(86) PCT No.: PCT/US2009/035583

§ 371 (c)(1),
(2), (4) Date: Aug. 25, 2011

(87) PCT Pub. No.: WO2011/146038

PCT Pub. Date: Nov. 24, 2011

(65) Prior Publication Data

US 2012/0013658 A1 Jan. 19, 2012

(51) Int. Cl.
*B41J 2/175* (2006.01)

(52) U.S. Cl.
USPC ..... 347/85; 347/86; 347/6

(58) Field of Classification Search
USPC ..... 347/5, 6, 9, 85, 86
See application file for complete search history.

(56) References Cited

U.S. PATENT DOCUMENTS

| | | | | |
|---|---|---|---|---|
| 5,949,458 | A | 9/1999 | Studholme | |
| 6,059,403 | A | 5/2000 | Burgin | |
| 6,254,226 | B1 * | 7/2001 | Lengyel et al. | 347/86 |
| 6,422,692 | B2 | 7/2002 | Yamazaki et al. | |
| 6,752,493 | B2 | 6/2004 | Dowell et al. | |
| 7,118,204 | B2 | 10/2006 | Hatasa et al. | |
| 7,334,887 | B2 * | 2/2008 | Andersen et al. | 347/86 |
| 7,349,654 | B2 | 3/2008 | Joo et al. | |
| 7,695,125 | B2 * | 4/2010 | Silverbrook et al. | 347/85 |

FOREIGN PATENT DOCUMENTS

| | | |
|---|---|---|
| JP | 2000/075624 | 3/2000 |
| JP | 2001/270131 | 10/2001 |
| JP | 2001/293880 | 10/2001 |
| JP | 2002/052734 | 2/2002 |

OTHER PUBLICATIONS

International Search Report and Written Opinion for PCT/US2009/035583 dated Feb. 6, 2012 (9 pages).

* cited by examiner

*Primary Examiner* — Lams S Nguyen

(57) ABSTRACT

A fluid cartridge for a printing device includes a housing including a floor, a chamber defined in the housing and configured to store an ink therein, a capillary medium disposed in the housing and in operative communication with the chamber, and a wick disposed at least partially in an opening of the floor, the wick including a portion extending a predetermined distance into the housing such that the wick portion contacts the capillary medium. The fluid cartridge further includes an enriched pigment-confining member established inside the housing such that the confining member physically contacts the floor and surrounds at least a portion of a periphery of the wick. The confining member is configured to i) block enriched ink from the wick, and/or ii) dilute the enriched ink prior to flowing through the wick.

15 Claims, 4 Drawing Sheets

FLUID CARTRIDGE FOR A PRINTING DEVICE

BACKGROUND

The present disclosure relates generally to fluid cartridges, and more particularly to a fluid cartridge for a printing device.

Inkjet printers often use replaceable fluid cartridges as a source of ink for printing. Such fluid cartridges include a housing often separated into one or more zones or chambers. For example, some fluid cartridges may be configured with a free ink chamber and at least one other chamber housing a capillary media. The free ink chamber and the other chamber(s) are configured to store an ink therein. During printing, the ink is selectively taken (or wicked) from one or more of the chambers via, e.g., a wick operatively connected to one or more nozzles of a printhead. The wick delivers the ink to the nozzles, and the ink is ejected through the nozzles onto a printing surface.

BRIEF DESCRIPTION OF THE DRAWINGS

Features and advantages of embodiment(s) of the present disclosure will become apparent by reference to the following detailed description and drawings, in which like reference numerals correspond to the same or similar, though perhaps not identical components. For the sake of brevity, reference numerals having a previously described function may or may not be described in connection with subsequent drawings in which they appear.

DETAILED DESCRIPTION

Figure 1:
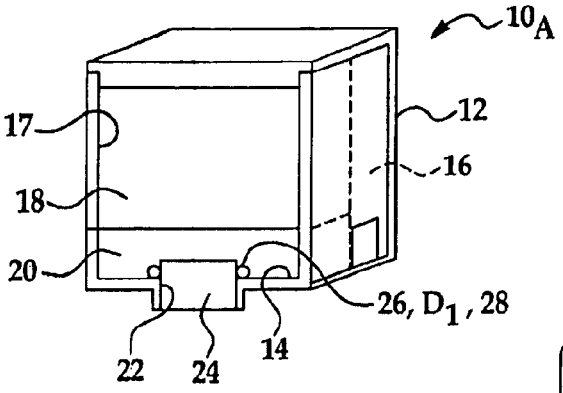
FIG. 1 is a semi-schematic perspective view of a fluid cartridge according to an embodiment as disclosed herein.

An embodiment of a fluid cartridge for a printing device (such as, e.g., inkjet printers selected from thermal inkjet printers, piezoelectric inkjet printers, continuous inkjet printers, and/or combinations thereof) is generally depicted in FIG. 1. The fluid cartridge $\mathbf{10}_A$ includes a housing 12 formed by any suitable means and formed by any suitable material. In a non-limiting example, the housing 12 is integrally molded as a single piece and is formed from a polymeric material. Non-limiting examples of suitable polymeric materials include polypropylenes, polypropylenes alloyed with polystyrenes, polyphenylene oxide, polyurethanes, and combinations thereof.

The housing 12 includes an interior space defined by a floor 14 and a continuous side wall 17 extending about the periphery of the floor 14. In an example, the interior space includes a free ink chamber 16 configured to store a volume of free ink therein, a chamber 18 housing a low capillary media (LCM), and a chamber 20 housing a high capillary media (HCM). The HCM 20 and LCM 18 chambers are in fluid communication with the free ink chamber 16 and are configured to store the ink therein.

The floor 14 includes an opening 22 defined therein. In an example, the opening 22 is defined in the floor 14 adjacent to the HCM chamber 20. The opening 22 couples with a manifold of a printhead (not shown) including a plurality of ink nozzles (also not shown). The opening 22 also couples at least with the HCM chamber 20, thereby providing fluid communication at least between the HCM in the chamber 20 and the opening 22.

The fluid cartridge $\mathbf{10}_A$ further includes a wick 24 disposed at least partially in the opening 22. In an embodiment, the wick 24 includes a portion extending a predetermined distance into the housing 12 such that the wick 24 portion contacts the capillary media of the chamber 20. Contact between the wick 24 and the capillary media of the chamber 20 enables fluid communication between the two. In an example, the wick 24 takes ink from the capillary media of the chamber 20 and delivers the ink to the printhead during printing.

The ink supplied by the fluid cartridge $\mathbf{10}_A$ includes a pigment-based ink. In an embodiment, the ink includes pigment particles suspended in a fluidic ink vehicle. In an example, the pigment-based ink may include a mixture of pigment particles having different particle sizes (in terms of effective radius, since not all of the particles may be spherically shaped). Without being bound to any theory, it is believed that the pigment particles having larger particle sizes tend to move in the suspension fluid toward a lowest gravitational point of the fluid cartridge $\mathbf{10}_A$ faster than pigment particles having smaller particle sizes. Such a theory may be referred to herein as the Stokes settling effect. The portion of the ink including the pigment particles that moved to the lowest gravitational point of the fluid cartridge $\mathbf{10}_A$, as well as the ink remaining (i.e., the ink including the particles that did not move to the lowest gravitational point of the fluid cartridge $\mathbf{10}_A$) generally includes larger pigment particles and smaller pigment particles. In an example, the ink including the pigment particles that settled has a higher mass fraction of total pigment particles than the ink prior to settling, and is referred to herein as a "concentrated ink" or "enriched ink". The remaining ink (i.e., the ink that gave up the pigment particles that settled) is referred to herein as a "non-concentrated ink". The non-concentrated ink generally includes a lower mass fraction of total pigment particles than the ink prior to settling. In an example, an amount of the pigment particles present in the enriched ink ranges from about 10 wt % to about 30 wt %, while the amount of pigment particles present in the non-concentrated ink ranges from about 2 wt % to about 5 wt %. In still another non-limiting example, the density of the non-concentrated ink ranges from about 1.01 g/cc to about 1.07 g/cc, while the density of the enriched ink ranges from about 1.08 g/cc to about 1.20 g/cc. In an embodiment, the enriched ink has a density of about 1.12 g/cc and includes about 20 wt % of pigment particles, while the non-concentrated ink has a density of about 1.04 g/cc and includes about 4 wt % of pigment particles.

The ink prior to the settling of the pigment particles to the lowest gravitational point of the fluid cartridge $\mathbf{10}_A$ generally includes pigment particles having a distribution of particle sizes. In an example, the median diameter of the pigment particles in the ink prior to the settling ranges from about 90 nm to about 150 nm. In another embodiment, the median diameter of the pigment particles of the ink prior to settling ranges from about 100 nm to about 140 nm. In still another embodiment, the median diameter of the pigment particles is about 120 nm. The enriched ink and the non-concentrated ink individually include pigment particles also having a distribution of particle sizes. In an example, the enriched ink has a median particle diameter that is larger than the median diameter of the ink prior to settling, whereas the non-concentrated ink has a median particle diameter that is lower than the median diameter of the ink prior to the settling.

It is to be understood that the median diameter of the pigment particles of the enriched ink and the non-concentrated ink depends, at least in part, on a length of time that the ink cartridge $\mathbf{10}_A$ is sitting in a position sufficient to enable such settling of the pigment particles. In a non-limiting example, if the fluid cartridge $\mathbf{10}_A$ is resting for a time period of about 3 months, and the median particle diameter of the ink prior to settling is about 120 nm, the median diameter of the enriched ink ranges from about 120 nm to about 160 nm, and the median particle diameter of the non-concentrated ink ranges from about 85 nm to about 120 nm. It is to be understood that the median diameter of the pigment particles present in the enriched ink generally increases over time as more and more of the larger pigment particles settle out of the original ink. As the fluid cartridge $\mathbf{10}_A$ sits for an amount of time sufficient for most of the smaller pigment particles to settle out with the larger pigment particles, the median diameter of the enriched ink actually reduces. It is further to be understood that although the median diameter of the pigment particles of the enriched ink reduces over time, the mass fraction of the pigment particles in the enriched ink is in fact larger than when the median diameter of the pigment particles was larger. Accordingly, in a non-limiting example, if the fluid cartridge $\mathbf{10}_A$ is resting for a time period of about 1 year and the median diameter of the ink prior to settling is about 120 nm, the median particle diameter of the enriched ink ranges from about 120 nm to about 140 nm, and the median particle diameter of the non-concentrated ink ranges from about 55 nm to about 120 nm.

Typically, the pigment particles included in the non-concentrated portion of the ink remain in the suspension over time when the cartridge $\mathbf{10}_A$ is sitting or in an idle state. The larger pigment particles, on the other hand, tend to settle toward the lowest gravitational point of the fluid cartridge $\mathbf{10}_A$ over time (as provided above). The lowest gravitational point of the fluid cartridge $\mathbf{10}_A$ is determined, at least in part, from the orientation of the fluid cartridge $\mathbf{10}_A$. If, for example, the cartridge $\mathbf{10}_A$ is sitting in an upright position (e.g., an operating position), then the lowest gravitational point may be a surface adjacent to the printhead (i.e., the floor 14). If, on the other hand, the cartridge $\mathbf{10}_A$ is lying on its side, the lowest gravitational point may be the lowest corresponding side surface of the cartridge $\mathbf{10}_A$.

To reiterate from above, when the fluid cartridge $\mathbf{10}_A$ sits for a period of time, the enriched ink (which has a density that is higher than that of the rest of the ink) settles to the lowest gravitational point of the cartridge $\mathbf{10}_A$. Without being bound to any theory, it is believed that the settling results from gravitational forces pulling on the larger and heavier pigment particles over time, causing the particles to fall faster than other smaller particles. The amount of time that it takes for the particles to settle out of the ink depends, at least in part, on the size of the particles, the density of the particles, and the absolute viscosity of the non-concentrated ink. For example, particles having a diameter of about 120 nm and a density of about 1.8 g/cc may take about 90 days to fall 1.5 cm in an ink having an absolute viscosity of about 3 cP.

Figure 2A:
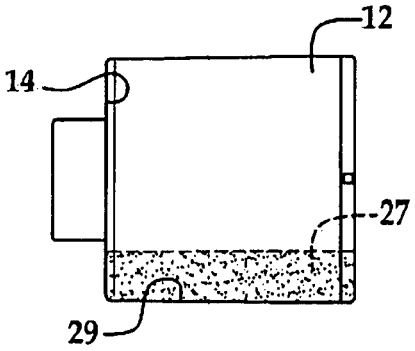
FIGS. 2A through 2F together depict a sequence of semi-schematic snap shots showing a flow of enriched pigment ink toward a floor of an ink cartridge when the ink cartridge is reoriented into an upright, operating position.
Figure 2B:
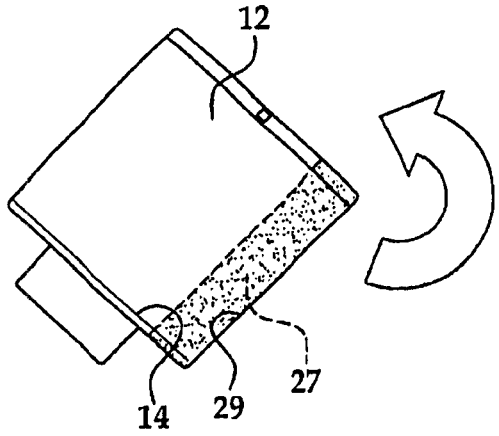
Figure 2C:
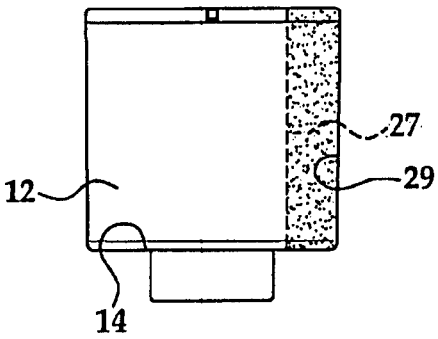
Figure 2D:
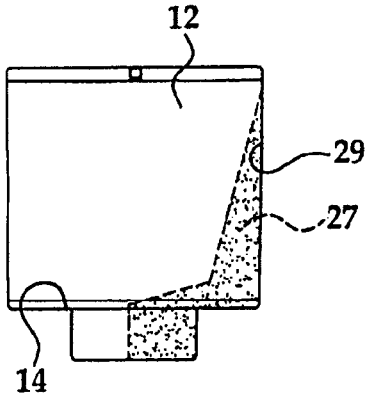
Figure 2E:
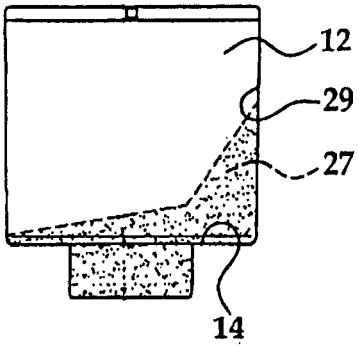
Figure 2F:
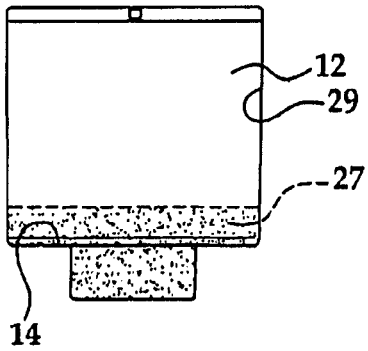

In some instances, the fluid cartridge $\mathbf{10}_A$ may sit on its side for a period of time before the cartridge $\mathbf{10}_A$ is turned to its upright, operating position (such as, e.g., when the fluid cartridge $\mathbf{10}_A$ is sitting in a desk drawer, on a shelf in a warehouse, etc.). The FIG. 2 series schematically depict a sequence of snap shots of an ink cartridge (similar to that shown in FIG. 1 but without a confining member (such as member 26, discussed further below)) showing the migration of enriched ink (identified by reference numeral 27 in the figures) collected at the lowest gravitational point. As the fluid cartridge sits or is in an idle state, the particles settle and fall to the lowest gravitational point (in this instance, the lowest gravitational point is the side 29 of the cartridge), and collect adjacent to the side 29 of the cartridge, as shown in FIG. 2A. It is to be understood that when the particles fall to the side 29 of the cartridge, the particles also fall through the LCM and the HCM (not shown in the FIG. 2 series). Reorientation of the cartridge to its upright position (i.e., the position in which the cartridge will be used during printing) (shown in FIGS. 2B and 2C) causes the enriched ink 27 collected on the side of the cartridge to move (i.e., flow) to the next lowest gravitational point of the cartridge under the influence of gravity (as shown in FIGS. 2D and 2E). The next lowest gravitational point, in this case, is the floor 14. In an example, the migration or flow of the enriched ink to the next lowest gravitational point may occur over a time period of, e.g., hours. Eventually, all of the collected enriched ink 27 has settled adjacent to the floor 14 (as shown in FIG. 2F).

The amount of time that it takes for the collected pigment particles to move through the capillary media to the floor 14 when the cartridge is reoriented may be based, at least in part, on, for example, the permeability of the capillary media, the viscosity of the collected enriched ink, and the density of the collected enriched ink relative to the non-concentrated ink.

As the collected enriched pigment ink 27 flows toward the floor 14 when the cartridge is placed in its upright position (as shown in FIGS. 2D and 2E), the collected enriched ink 27 will then flow, still under the influence of gravity, toward still the next lowest gravitational point of the cartridge. In this case, the next lowest gravitational point is the wick 24. In instances where the enriched ink 27 contact the wick 24, the enriched ink 27 may migrate through the wick 24 and into the nozzles of the printhead. In an example, the flow of the enriched ink 27 during printing may occur over a time period of, e.g., fractions of a second or seconds. In some instances, the enriched ink 27 may adversely affect print quality as the enriched ink 27 passes through the nozzles.

Without being bound to any theory, it is believed that an enriched pigment-confining member (referred to hereinbelow as "the confining member" and identified by reference numeral 26) established inside the fluid cartridge $\mathbf{10}_A$ may i) block the enriched ink 27 from the wick 24, and/or ii) dilute the enriched ink 27 prior to flowing through the wick 24. Such blocking generally occurs during the migration/flow of the enriched ink 27 to the lowest gravitational point of the fluid cartridge $\mathbf{10}_{A\text{-}J}$. It is believed that the confining member 26 blocks the enriched ink 27 from the wick 24 by creating, for example, a physical barrier around at least a portion of the periphery of the wick 24 or, in some cases, the entire periphery of the wick 24. In any event, the physical barrier is created at locations where a direct flow path of the enriched ink 27 to the wick 24 may be present, thereby blocking the flow path of the enriched ink 27 to the wick 24.

It is to be understood that, in some cases, the enriched ink 27 may still contact the wick 24 when the ink is drawn or extracted from the chambers 16, 18, and 20 by the printhead during printing, even in the presence of the physical barrier. In these instances, the enriched ink 27 may also be drawn or extracted out of the cartridge 10 by the printhead along with (or parallel with) the ink. When the enriched ink 27 contacts the non-concentrated ink, the enriched ink 27 and the non-concentrated ink mix, thereby diluting the enriched ink 27. In an embodiment, complete/substantially complete diluting of the enriched ink 27 may occur prior to the enriched ink 27 (now re-mixed with the non-concentrated ink) contacting the wick 24. In another embodiment, complete/substantially complete diluting of the enriched ink 27 may occur after the enriched ink 27 contacts the wick 24. In this embodiment, the enriched ink 27 re-mixes with the non-concentrated ink while the inks flow into the wick 24. In any event, it is believed that the settled particles, once re-mixed with the non-concentrated ink, may be suitably ejected by the printhead during printing without clogging or otherwise hindering ejection performance of the nozzles.

The blocking and/or diluting of the enriched ink 27 in the fluid cartridge $\mathbf{10}_A$ advantageously reduce clogging of the nozzles and/or reduce other possible deleterious effects to ejection performance of the nozzles during printing. Furthermore, the blocking and/or diluting may: reduce priming of the ink prior to printing; and reduce i) the overall time associated with ejection of the ink onto the printing surface, and ii) waste with respect to ink that may not be used as a result of clogging the nozzles with the enriched ink 27. Additionally, the blocking and/or diluting increases the number and types of inks that may be used inside the ink cartridge $\mathbf{10}_A$. Yet further, use of the confining member 26 eliminates recirculation mechanisms or designs in the cartridge $\mathbf{10}_A$, such as for re-mixing of the ink and/or re-suspending of the enriched ink in the non-concentrated ink.

Some embodiments of the fluid cartridge are depicted in FIG. 1 and FIGS. 3A through 3E, and are identified by reference characters $\mathbf{10}_A$, $\mathbf{10}_B$, $\mathbf{10}_C$, $\mathbf{10}_D$, $\mathbf{10}_E$, and $\mathbf{10}_F$. In all of these embodiments, the confining member 26 is a dam selected from a ring dam (identified by reference character $D_1$ and shown in the fluid cartridge $\mathbf{10}_A$ of FIG. 1), an H-dam (identified by reference character $D_2$ and shown in the fluid cartridge $\mathbf{10}_B$ of FIG. 3A), a straight dam (identified by reference character $D_3$ and shown in the fluid cartridge $\mathbf{10}_C$ of FIG. 3B), an angled dam (identified by reference character $D_4$ and shown in the fluid cartridge $\mathbf{10}_D$ of FIG. 30), an A-dam (identified by reference character $D_5$ and shown in the fluid cartridge $\mathbf{10}_E$ of FIG. 3D), and a molded ring dam (identified by reference character $D_6$ and shown in the fluid cartridge $\mathbf{10}_F$ of FIG. 3E). In such embodiments of the fluid cartridge $\mathbf{10}_A$ through $\mathbf{10}_F$, the confining member 26 is established inside the housing 12 adjacent to the floor 14 and surrounding at least a portion of the periphery of the wick 24. The confining member 26 is generally configured to provide a volume inside the housing 12 to trap the enriched ink 27 inside the housing 12. The trapping occurs, e.g., without blocking all potential flow paths of the ink to the wick 24 during idling of the cartridge 10 except for flow paths that enable migration of enriched ink 27 to the lowest gravitational point in the fluid cartridge $\mathbf{10}_A$, $\mathbf{10}_B$, $\mathbf{10}_C$, $\mathbf{10}_D$, $\mathbf{10}_E$, $\mathbf{10}_F$ (referred to herein as "level flow paths"). Such level flow paths may occur, e.g., from a crack or other perforation present in the confining member 26. Such level flow paths may, in some instances, defeat the purpose of the trapping property of the confining member 26. In other words, the confining member 26 forms a sump inside housing 12 collecting the enriched ink 27, where the sump does not, in most if not all instances, interfere with normal operations of all embodiments of the fluid cartridge 10.

In the embodiments of the fluid cartridge $\mathbf{10}_A$ through $\mathbf{10}_E$ depicted in FIGS. 1 and 3A through 3D, the confining member 26 (i.e., dams $D_1$, $D_2$, $D_3$, $D_4$, and $D_5$) is a removable dam placed or disposed inside the housing adjacent to the floor 14 and surrounding the periphery of the wick 24. The removable dam may be made, e.g., of a polymer (e.g., rubber), or any other suitable material. In an example, the confining member 26 sealingly engages the floor 14 to substantially prevent the enriched ink 27 from migrating underneath the confining member 26, and from finding a level flow path to the wick 24. Such migration is due, at least in part, to the higher density of the enriched ink 27 compared to the non-concentrated ink. In another example, the confining member 26 has a height measured from the floor 14 to the top of the confining member 26, where the height is sufficient to substantially prevent the enriched ink 27 from finding another direct (in this case, a level) flow path to the wick 24. In an example, the height of the dam ranges from about 1 mm to about 3 mm.

Figure 3A:
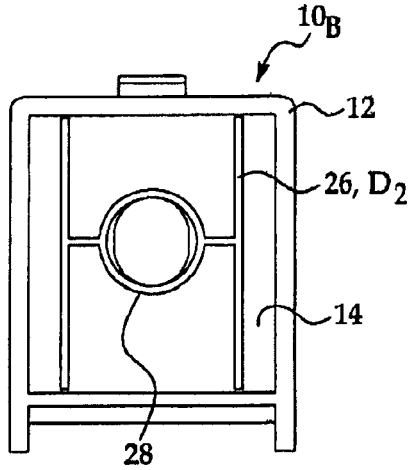
FIGS. 3A through 3E semi-schematically depict various other embodiments of the fluid cartridge.
Figure 3B:
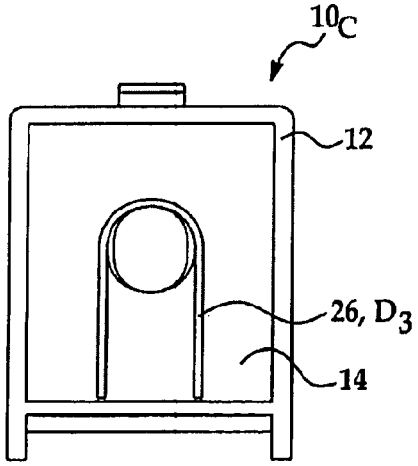
Figure 3C:
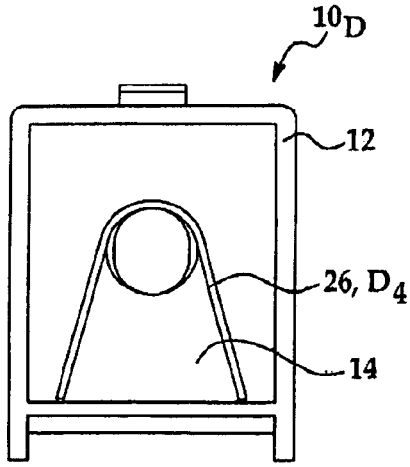
Figure 3D:
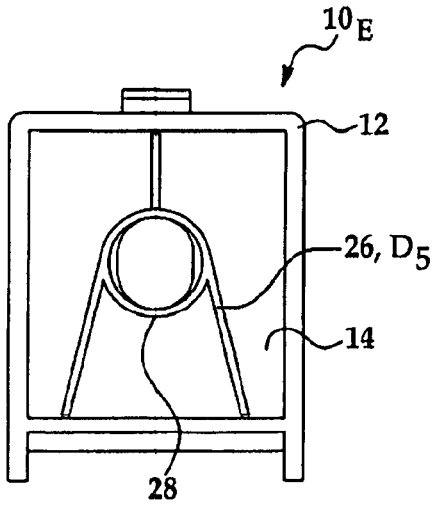
Figure 3E:
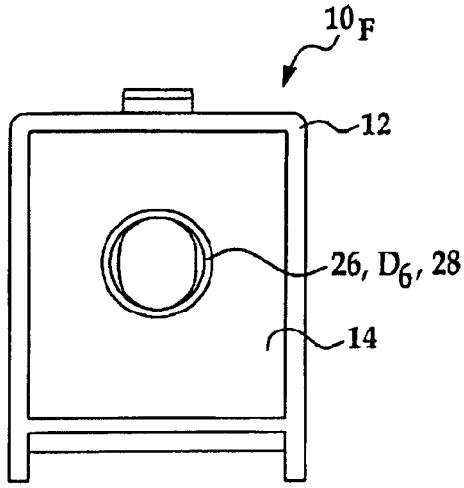
Figure 4:
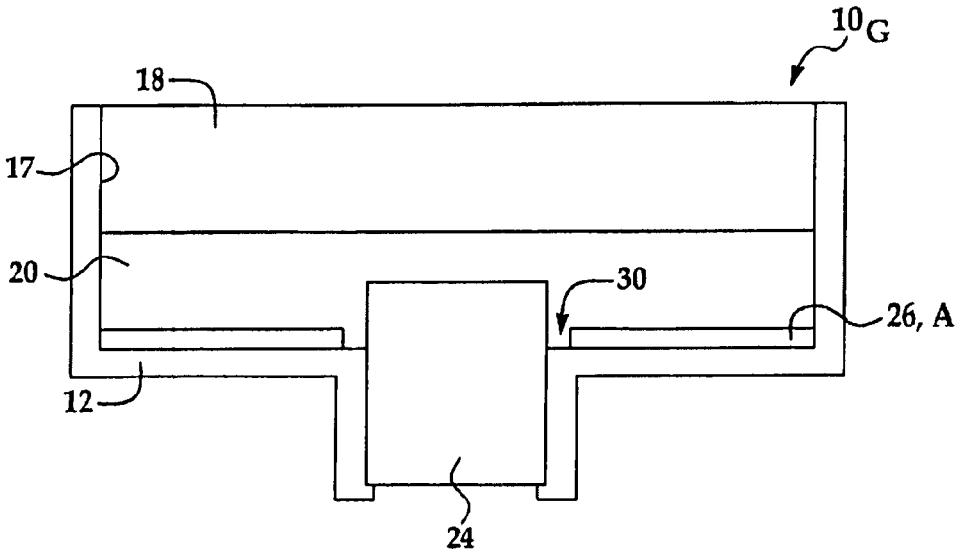
FIG. 4 schematically depicts yet another embodiment of the fluid cartridge.

In the embodiment of the fluid cartridge $\mathbf{10}_F$ depicted in FIG. 3E, the confining member 26 (i.e., the dam $D_6$) is a ring dam molded inside the housing 12 adjacent to the floor 14 and surrounding the periphery of the wick 24. Without being bound to any theory, it is believed that molding the dam $D_6$ integrally with the floor 14 i) creates a true seal between the dam $D_6$ and the floor 14, and ii) reduces the complexity of the cartridge $\mathbf{10}_F$, thereby simplifying fabrication thereof. Furthermore, inclusion of the molded dam $D_6$, integrally formed with the cartridge $\mathbf{10}_F$ as a single part, is relatively easy, resulting in substantially minimal increases to material cost and/or production time.

As provided above, the confining member 26 may, in some instances, be configured to surround a portion of the periphery of the wick 24 (such as the straight dam $D_3$ and the angled dam $D_4$ shown in FIGS. 3B and 30, respectively). In other instances, the confining member 26 includes a ring portion 28, where the ring portion 28 surrounds the entire periphery of the wick 24 (such as the ring dam $D_1$, the H-dam $D_2$, the A-dam $D_5$, and the molded ring dam $D_6$). It is to be understood that the selection of the dam depends, at least in part, on the configuration of the housing 12 and whether or not level flow paths (present in a gravity field) may potentially form directly to the wick, around the entire periphery of the wick 24, and/or at one or more portions of the periphery of the wick 24. In any event, the dam selected should i) provide a settling plain for the enriched ink 27, and ii) keep the settling plain as far away as possible from the wick 24 and/or from any flow paths directed toward the wick 24.

In an embodiment, the enriched pigment-confining member 26 includes an absorption layer A, shown in embodiments of the fluid cartridge $\mathbf{10}_G$, $\mathbf{10}_H$, $\mathbf{10}_I$, $\mathbf{10}_J$ depicted in FIGS. 4, 5A, 5B, and 6, respectively. The absorption layer A is generally a thin sheet of high capillary media having a capillarity between that of the HCM disposed in the chamber 20 and that of the wick 24. In a non-limiting example, the absorption layer A has a material density ranging from about 0.1 g/cc to about 0.2 g/cc. In another example, the absorption layer A has a material density ranging from about 0.11 g/cc to about 0.16 g/cc.

In an example, the absorption layer A is configured to impede a flow of the enriched ink 27 by, e.g., allowing the enriched ink to flow into its capillaries. Without being bound to any theory, it is believed that the absorption layer A holds the enriched ink insides its capillaries and substantially disallows the enriched ink from be extracted by the wick 24 during printing and/or priming. In a non-limiting example, the thickness of the absorption layer A ranges from about 1 mm to about 3 mm, and the volume of the absorption layer A ranges from about 0.9 cc to about 2.7 cc.

The absorption layer A is also disposed inside the housing 12 adjacent to the floor 14 and surrounding at least a portion of the periphery of the wick 24. As shown in the embodiment of the fluid cartridge $\mathbf{10}_G$ depicted in FIG. 4, an air gap 30 forms between the absorption layer A and the wick 24. Without being bound to any theory, it is believed that the air gap 30 acts as a suitable obstruction placed between the enriched ink 27 and the wick 24, blocking or obstructing a direct flow path of the enriched ink 27 to the wick 24. Accordingly, the air gap 30 may, in and of itself, be considered a dam.

Figure 5A:
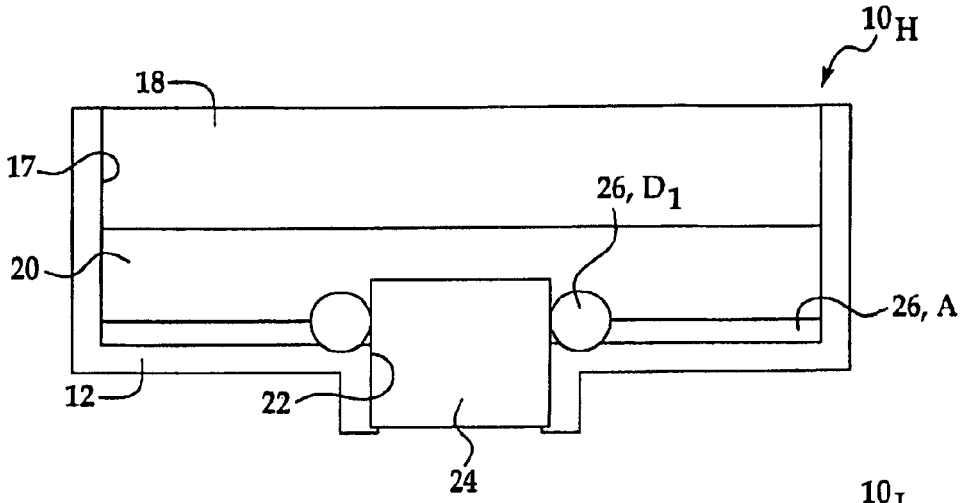
FIGS. 5A and 5B schematically depict still a further embodiment of the fluid cartridge.
Figure 5B:
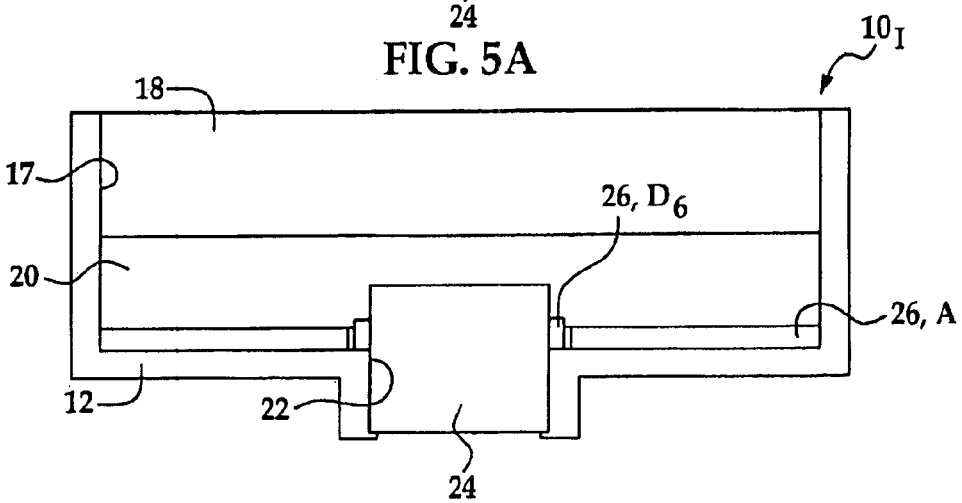

In yet another embodiment, the confining member 26 may include a dam selected from a ring dam $D_1$ and an absorption layer A (as shown in the fluid cartridge $\mathbf{10}_H$ of FIG. 5A). In still another embodiment, the confining member 26 may include a dam selected from a molded ring dam $D_6$ and absorption layer A (as shown in the fluid cartridge $\mathbf{10}_I$ of FIG. 5B). In such embodiments, the height of the dam $D_1$ and $D_6$ is larger than the height of the absorption layer A to reduce a flow of the enriched ink 27 absorbed by the absorption layer A over the dam $D_1$, $D_6$. It is to be understood that the height of the absorption layer A and the dam $D_1$, $D_6$ depends, at least in part, on the type of ink stored by the cartridge $\mathbf{10}_H$, $\mathbf{10}_I$, the shelf and/or service life of the cartridge $\mathbf{10}_H$, $\mathbf{10}_I$, the cartridge $\mathbf{10}_H$, $\mathbf{10}_I$ geometry, and/or other similar factors.

Figure 6:
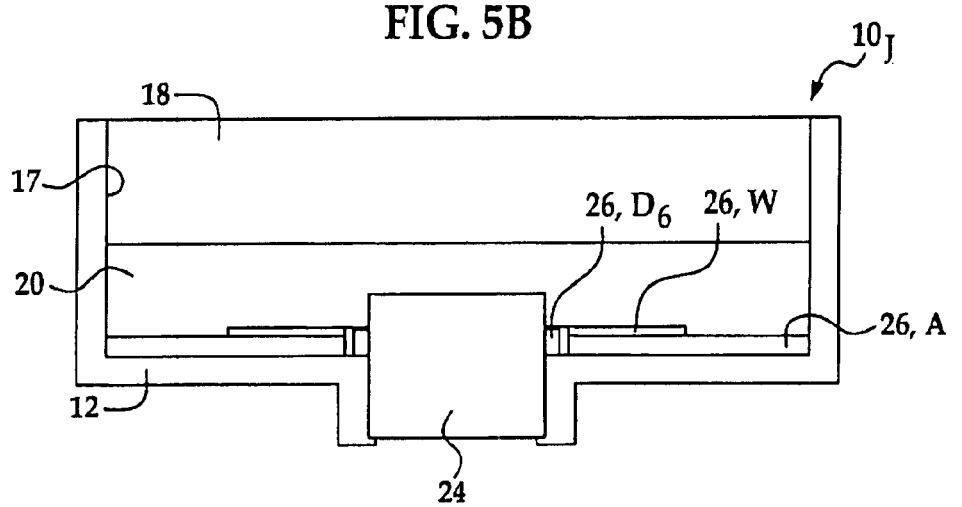
FIG. 6 schematically depicts a fluid cartridge according to yet another embodiment.

In still a further embodiment, the confining member 26 may include a dam selected from a molded ring dam $D_6$, an absorption layer A, and a washer W (as shown in the fluid cartridge $\mathbf{10}_J$ of FIG. 6). In this embodiment, the washer W surrounds at least a portion of the periphery of the wick 24 and is positioned adjacent to the dam $D_1$, $D_6$ and/or the absorption layer A. The washer W advantageously blocks any potential flow paths that may have been created around the dam $D_1$, $D_6$ and/or the absorption layer A to the wick 24.

It is to be understood that other combinations including one or more of the dams $D_1$-$D_6$ may be used, non-limiting examples of which include an angled dam $D_4$ and/or a ring dam $D_1$, with or without an absorption layer A, and with or without a washer W.

The embodiments of the fluid cartridge 10 shown in the figures may be made by, e.g., molding the cartridge 10 as a single piece and disposing the confining member 26 therein. In an example, the confining member 26 is chemically and/or mechanically attached to the floor 14 and/or to the wick 24 in a manner sufficient to sealingly engage the confining member 26 with the floor 24. In other embodiments of the fluid cartridge 10 (such as the cartridge $\mathbf{10}_F$ shown in FIG. 3E), the fluid cartridge $\mathbf{10}_F$ including the confining member 26 is molded as a single piece.

It is to be understood that the term "connect/connected" or "couple/coupled" are broadly defined herein to encompass a variety of divergent connection or coupling arrangements and assembly techniques. These arrangements and techniques include, but are not limited to (1) the direct connection or coupling between one component and another component with no intervening components therebetween; and (2) the connection or coupling of one component and another component with one or more components therebetween, provided that the one component being "connect to" or "coupled to" the other component is somehow operatively connected to the other component (notwithstanding the presence of one or more additional components therebetween).

While several embodiments have been described in detail, it will be apparent to those skilled in the art that the disclosed embodiments may be modified. Therefore, the foregoing description is to be considered exemplary rather than limiting.

What is claimed is:

1. A fluid cartridge for a printing device, comprising:

a housing including a floor having an opening defined therein;

a chamber defined in the housing and configured to store an ink therein, the ink including an enriched ink;

a capillary medium disposed in the housing and in operative fluid communication with the chamber;

a wick disposed at least partially in the opening, the wick including a portion extending a predetermined distance into the housing such that the wick portion contacts the capillary medium; and an enriched pigment-confining member established inside the housing such that the confining member physically contacts the floor and surrounds at least a portion of a periphery of the wick, the confining member configured to i) block the enriched ink from the wick, ii) dilute the enriched ink prior to flowing through the wick, or iii) combinations thereof.

2. The fluid cartridge as defined in claim 1 wherein the enriched pigment-confining member includes a dam selected from an A-dam, an H-dam, a straight dam, an angled dam, a ring dam, a molded ring dam, and combinations thereof.

3. The fluid cartridge as defined in claim 2 wherein the dam includes a ring portion, the ring portion surrounding the entire periphery of the wick.

4. The fluid cartridge as defined in claim 2 wherein the enriched pigment-confining member further includes an absorption layer, the absorption layer being formed from an other capillary medium and configured to confine at least a portion of the enriched ink therein.

5. The fluid cartridge as defined in claim 4, further comprising a washer disposed in the housing and surrounding the at least the portion of the periphery of the wick, and wherein the washer is positioned adjacent to: the dam; the absorption layer; or combinations thereof.

6. The fluid cartridge as defined in claim 2 wherein the dam contacts at least a portion of the wick, and wherein the dam includes a height sufficient to block the enriched ink from the wick.

7. The fluid cartridge as defined in claim 2 wherein the dam is configured to trap at least a portion of the enriched ink in the housing.

8. The fluid cartridge as defined in claim 2 wherein the dam sealingly engages with the floor.

9. A method of making a fluid cartridge for a printing device, the method comprising:

defining an opening in a floor of a housing;

defining a chamber in the housing, the chamber configured to store an ink therein, the ink including an enriched ink;

disposing a capillary medium in the housing, the capillary medium in operative fluid communication with the chamber;

disposing a wick at least partially in the opening, the wick including a portion extending a predetermined distance into the housing such that the portion contacts the capillary medium; and establishing an enriched pigment-confining member inside the housing such that the confining member physically contacts the floor and surrounds at least a portion of a periphery of the wick, the confining member configured to i) block the enriched ink from the wick, ii) dilute the enriched ink prior to flowing through the wick, or iii) combinations thereof.

10. The method as defined in claim 9 wherein the confining member includes a dam, and wherein the method further comprises establishing the dam inside the housing, adjacent to the at least the portion of the periphery of the wick.

11. The method as defined in claim 10 wherein the confining member further includes an absorption layer, and wherein the method further comprises establishing the absorption layer inside the housing, adjacent to the dam.

12. The method as defined in claim 11, further comprising disposing a washer in the housing and surrounding the at least the portion of the periphery of the wick, wherein the washer is positioned adjacent to: the dam; the absorption layer; or combinations thereof.

13. The method as defined in claim 10 wherein the dam sealingly engages with the floor.

14. A method of reducing effects of settling of an enriched ink in a pigment-based ink system, the method comprising:

providing an ink cartridge, comprising:

a housing including a floor having an opening defined therein;

a chamber defined in the housing and configured to store an ink therein, the ink including the enriched ink;

a capillary medium disposed in the housing and in operative fluid communication with the chamber;

a wick disposed at least partially in the opening, the wick including a portion extending a predetermined distance into the housing such that the portion contacts the capillary medium; and an enriched pigment-confining member established inside the housing such that the confining member physically contacts the floor and surrounds at least a portion of a periphery of the wick; and at least one of i) blocking the enriched ink from the wick, or ii) diluting the enriched ink prior to flowing through the wick.

15. The method as defined in claim 14 wherein the confining member is selected from a dam, an absorption layer, and combinations thereof.

* * * * *